US008033916B2

(12) United States Patent
Caldwell et al.

(10) Patent No.: US 8,033,916 B2
(45) Date of Patent: Oct. 11, 2011

(54) GRIP PRESSURE SENSOR

(76) Inventors: Theodore Caldwell, Laguna Beach, CA (US); Ning Chen, Yorba Linda, CA (US)

( * ) Notice: Subject to any disclaimer, the term of this patent is extended or adjusted under 35 U.S.C. 154(b) by 924 days.

(21) Appl. No.: 11/733,145

(22) Filed: May 4, 2007

(65) Prior Publication Data

US 2008/0274819 A1 Nov. 6, 2008

(51) Int. Cl.
*A63F 13/00* (2006.01)
*A63B 67/02* (2006.01)

(52) U.S. Cl. ..... 463/46; 463/3; 463/7; 463/47; 273/108.2; 273/245; 273/317.2; 273/460; 473/131; 473/140; 473/212; 473/213; 434/252

(58) Field of Classification Search ..... 463/2–3, 463/5, 7, 23, 30–32, 36–37, 42–43, 46–47, 463/50, 53, 56; 273/108.2, 108.21, 150, 273/245, 317.1, 317.2, 329–331, 359, 366–368, 273/406–408, 441, 444–446, 453, 460–461; 473/131, 136, 140–141, 143, 145–146, 150–153, 473/156, 158, 160, 202, 204–217, 219–226, 473/231, 234, 257, 266, 280, 353, 405; 434/252; 702/141, 142, 160, 182; *A63F 13/00; A63B 67/02*
See application file for complete search history.

(56) References Cited

U.S. PATENT DOCUMENTS 4,058,118 A * 11/1977 Stupay et al. ..... 600/503
4,222,569 A * 9/1980 DeMascolo ..... 473/213
4,269,193 A * 5/1981 Eckerle ..... 600/485
4,307,727 A * 12/1981 Haynes ..... 600/485
4,331,154 A * 5/1982 Broadwater et al. ..... 600/490
4,387,437 A * 6/1983 Lowrey et al. ..... 702/160
(Continued)

FOREIGN PATENT DOCUMENTS

DE 2846010 A * 4/1980
(Continued)

OTHER PUBLICATIONS

Tekscan, FlexiForce(R) Sensors User Manual (Rev G), Feb. 5, 2009.

*Primary Examiner* — Arthur O. Hall

(57) ABSTRACT

Grip pressure is monitored by a collection of battery powered components embodied in an assembly analogous to an ordinary wrist watch, that is a watch housing or casement and a stretchable band. The system, which we shall refer to as a swing monitor, is worn on the wrist and deployed in such a way that the back of the housing or casement is cinched securely to the back or underside of the wrist. A pressure plate on the back of the watch makes contact with the pulse region of the wrist. The flexing and relaxing of the muscles and tendons of the wearer is read by an electronic pressure sensing device, a piezo sensor. A tighter grip will register greater pressure and a looser grip, less pressure. The device records grip pressure associated with the swing of a golf club, tennis racquest or baseball bat, among other articles of sports equipment meant to be swung. The grip pressure determined to be optimal, that is giving the desired result, can be SAVED in the memory of the swing monitor system. Subsequent swings and their associated grip pressures are compared with the SAVED value of the optimal or best swing. An audible signal alerts the wearer if the grip pressure departs from that registered on the optimal or best swing.

17 Claims, 3 Drawing Sheets

A PIEZO SENSOR STRIP 1 ½ INCHES LONG IS FITTED INSIDE THE DOMED PRESSURE PLATE. THIN GUAGE ELECTRICAL WIRE LEADS FROM THE SENSOR TO A 3V BATTERY, THEN TO AN A/D CONVERTER.

U.S. PATENT DOCUMENTS

| | | | | | |
|---|---|---|---|---|---|
| 4,409,983 | A | * | 10/1983 | Albert | 600/503 |
| 4,987,900 | A | * | 1/1991 | Eckerle et al. | 600/485 |
| 5,261,412 | A | * | 11/1993 | Butterfield et al. | 600/485 |
| 5,406,952 | A | * | 4/1995 | Barnes et al. | 600/485 |
| 5,511,789 | A | * | 4/1996 | Nakamura | 473/202 |
| 5,551,437 | A | * | 9/1996 | Lotscher | 600/485 |
| 5,581,484 | A | * | 12/1996 | Prince | 702/150 |
| 5,588,919 | A | * | 12/1996 | Nakamura | 473/212 |
| 5,655,223 | A | * | 8/1997 | Cozza | 2/161.2 |
| 5,681,993 | A | * | 10/1997 | Heitman | 73/379.02 |
| 5,688,183 | A | * | 11/1997 | Sabatino et al. | 473/212 |
| 5,733,201 | A | | 3/1998 | Caldwell | |
| 5,771,492 | A | * | 6/1998 | Cozza | 2/161.2 |
| 5,807,267 | A | * | 9/1998 | Bryars et al. | 600/500 |
| 5,873,788 | A | * | 2/1999 | Hoffman | 473/205 |
| 5,895,326 | A | * | 4/1999 | Cozza et al. | 473/213 |
| 5,907,282 | A | * | 5/1999 | Tuorto et al. | 340/576 |
| 6,037,703 | A | * | 3/2000 | Kambe et al. | 310/338 |
| 6,196,932 | B1 | | 3/2001 | Marsh et al. | |
| 6,224,493 | B1 | | 5/2001 | Lee et al. | |
| 6,401,254 | B1 | * | 6/2002 | Boller | 2/161.2 |
| 6,402,634 | B2 | | 6/2002 | Lee et al. | |
| 6,491,647 | B1 | * | 12/2002 | Bridger et al. | 600/585 |
| 6,772,442 | B2 | * | 8/2004 | Erker | 2/161.2 |
| 6,913,559 | B2 | * | 7/2005 | Smith | 482/4 |
| 7,101,287 | B1 | * | 9/2006 | Wagner | 473/207 |
| 7,140,248 | B1 | | 11/2006 | Brundage | |
| 7,264,554 | B2 | * | 9/2007 | Bentley | 473/222 |
| 7,341,561 | B2 | * | 3/2008 | Tanaka et al. | 600/503 |
| 7,600,430 | B2 | * | 10/2009 | Palin et al. | 73/700 |
| 7,780,541 | B2 | * | 8/2010 | Bauer | 473/205 |
| 7,839,383 | B2 | * | 11/2010 | Li et al. | 345/156 |
| 2001/0005695 | A1 | | 6/2001 | Lee et al. | |
| 2001/0053720 | A1 | | 12/2001 | Lee et al. | |
| 2002/0077189 | A1 | * | 6/2002 | Tuer et al. | 473/151 |
| 2004/0216216 | A1 | * | 11/2004 | Terris et al. | 2/161.2 |
| 2005/0113167 | A1 | * | 5/2005 | Buchner et al. | 463/30 |
| 2005/0119036 | A1 | | 6/2005 | Albanna et al. | |
| 2006/0199659 | A1 | * | 9/2006 | Caldwell | 473/221 |
| 2007/0010341 | A1 | * | 1/2007 | Miettinen et al. | 473/131 |
| 2009/0163824 | A1 | * | 6/2009 | Ide et al. | 600/499 |

FOREIGN PATENT DOCUMENTS

| | | | |
|---|---|---|---|
| JP | 08173586 | | 7/1996 |
| JP | 08173586 | A * | 7/1996 |
| JP | 10043350 | A * | 2/1998 |

* cited by examiner

A PIEZO SENSOR STRIP 1 ½ INCHES LONG IS FITTED INSIDE THE DOMED PRESSURE PLATE. THIN GUAGE ELECTRICAL WIRE LEADS FROM THE SENSOR TO A 3V BATTERY, THEN TO AN A/D CONVERTER.

FIGURE 2. SCHEMATIC DIAGRAM OF PRESSURE SENSOR CIRCUIT.

FIGURE 3. LCD LAYOUT SHOWING DIRECTION INDICATOR OF GRIP PRESSURE AND DIGITAL VALUE.

FIGURE 4. ILLUSTRATION OF DATA COLLECTION BY GRIP SENSOR
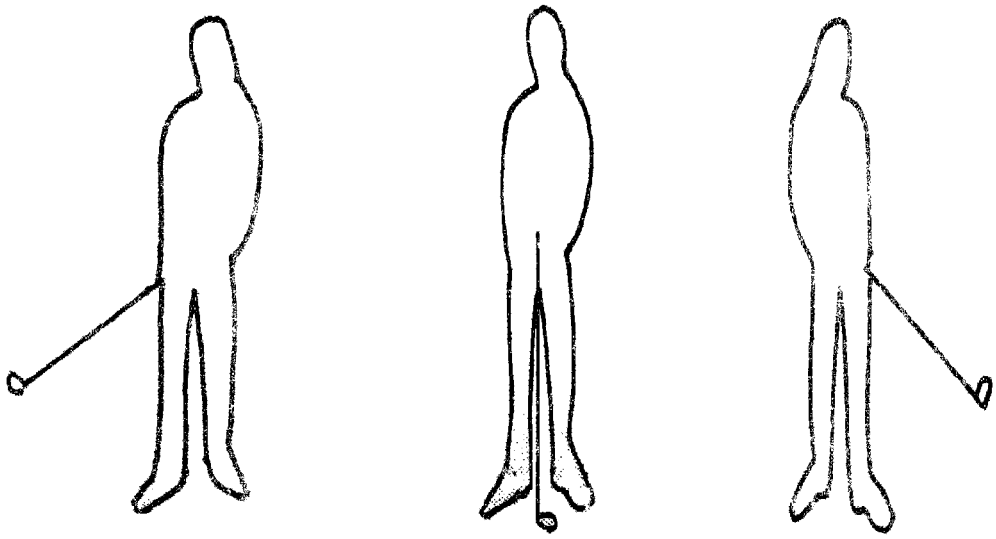
R1……R2 ……..R3……..R4…..R5
Time=N zero……Time=N+1

GRIP PRESSURE SENSOR

BACKGROUND

1. Field of the Invention

This invention is directed to a swing training or teaching device, in general, and to such a training device in the form wrist watch and strap or band to be worn on the wrist of the user and which incorporates components and assemblies for measuring the grip pressure parameter of the swing.

2. Prior Art Statement

Various sports have developed equipment that until very recently, say the last 25 years, was rather basic, if not primitive. Now that modern technology has come into the sports, the equipment and apparatuses dedicated to the sports are becoming more and more technologically advanced or sophisticated.

Improving one's swing is one of the ways golf, tennis and baseball enthusiasts can increase their proficiency. There are special clubs, bats, and racquets as well as weights, video tapes and many other techniques for utilization during practice sessions. The extant learning devices are primarily based on the feedback the athlete receives from them and thus learn the correct technique while avoiding wrong techniques.

One of the more subtle difficulties encountered by most athletes is the grip pressure of the swing. There is no absolutely correct grip pressure of the swing. Trial and error is the only reliable way to discover the swing that produces the best result. Once that discovery is made the athlete needs to development muscle and grip memory in order to repeat the swing and hence replicate the desired result.

One device known in the art that helps the golfer in some sense memorize and repeat the same golf swing that produces the desired result is a glove worn on the hand of the user as described in U.S. Pat. No. 5,733,201 by the same inventor. While the glove unit is a highly accurate and desirable device, it has the inherent drawback that it is in the form of a glove. The glove is not interchangeable to allow use by either a right-handed or left-handed golfer, there is significant variation in sizing and the glove can not be made as durable as the monitoring instrumentation attached to it.

SUMMARY OF THE INSTANT INVENTION

The system used to monitor grip pressure is contained in a device analogous to a ordinary wrist watch. The back plate of the watch is in contact with the pulse pressure points on the wrist of the wearer. As hand grip pressure varies, as when gripping say a golf club handle, baseball bat, or tennis racquet, an electronic sensing device, a battery powered piezo sensor strip, for example a Tekscan FlexiForce® A201 Sensor (Tekscan, Inc., South Boston, Mass.) embedded in the watch casement, sends an electronic impulse to an A/D converter. The greater the force of the grip exerted by the wearer, the higher the grip pressure value recorded by the device, and conversely, the slighter the grip pressure, the lower the value.

The Tekscan FlexiForce® A201 Sensor is an ultra-thin and flexible printed circuit that can act as a force sensing resistor (e.g., a variable resistor) in an electrical circuit. It can measure force between two surfaces. When the force sensor is unloaded, its resistance is very high. When a force is applied to the sensor, this resistance decreases. The resistance can be read by connecting a multimeter or other circuitry to the outer two pins, then applying a force to the sensing area. As examples, force versus resistance or force versus conductance (1/R) may be measured where the conductance curve is linear, and therefore useful in calibration. One way to integrate the FlexiForce® sensor into an application is to incorporate it into a force-to-voltage circuit. The A201 model has a sensing area of about 0.375 inches in diameter with a response time of less than about 5 microseconds. The A201 model is available in various force ranges (e.g., 0-1 lb (4.4 N); 0-25 lb (110 N); and 0-100 lb (440 N)).

An LCD, deployed on the watch face, displays the grip pressure as a digital value. The system allows the wearer to SAVE a single grip pressure value in the memory. Subsequent grips are sequentially compared with the one saved in memory. The system compares each subsequent grip pressure value with the saved or benchmark grip pressure value. An audible signal alerts the wearer that he/she has used a different grip pressure from that saved. Additionally, visually, displayed on the watch face are arrows indicating a stronger or weaker grip.

BRIEF DESCRIPTION OF THE DRAWINGS

FIG. 1 displays the watch housing or casement and the pressure plate deployed at the back of the monitoring device. Note the pressure plate is made of thin metal and domed so as to more acutely sense subtle changes in the expansion and contraction of the muscles and tendons in the wrist of the wearer.

FIG. 3 is the layout of the LCD 300 showing the digital value display of the grip pressure, as well as the direction indicator of greater or lesser grip pressure than that SAVED in memory. This application of the instant invention is embodied in a multifunction application, hence the LCD illustrated displays two additional functions, swing speed and elapsed time of the swing.

FIG. 4 attempts to show the data collection process of the instant invention. From Tim0, or the start of a swing to Time=+1, or the finish of the swing, five discrete values for grip pressure, represented here by R1, . . . R5, can be recorded.

DESCRIPTION OF A PREFERRED EMBODIMENT

Figure 1:
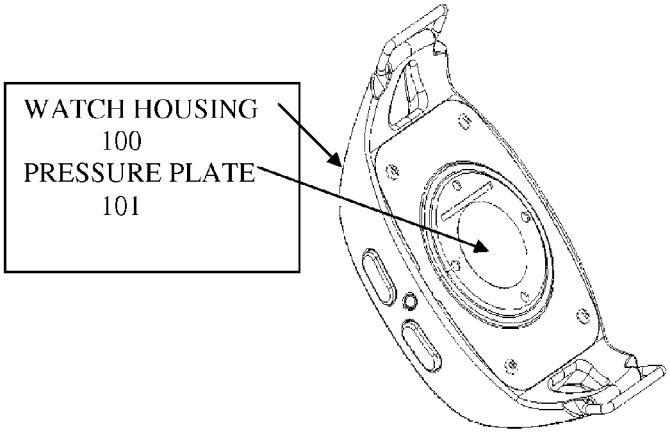
FIG. 1 is a schematic drawing of one embodiment of the watch housing 100 and back pressure plate of the instant invention 101. When deployed, the watch housing is held in close contact with the pulse point of wearer's wrist by a stretchable band secured by a hook and loop VELCRO® material fastener.

FIG. 1 is a representation of the outside housing 100 of the instant invention. The watch's back plate, 101 made of thin metal alloy is cinched securely to the wearer's wrist and makes contact with the pulse pressure points. The domed shape of the back plate is pliable. When the muscles and tendons in the wearer's wrist expand and contract as a result of variable grip pressure, the metal plate will similarly respond to the pressure emanating from the wearer's grip.

Figure 2:
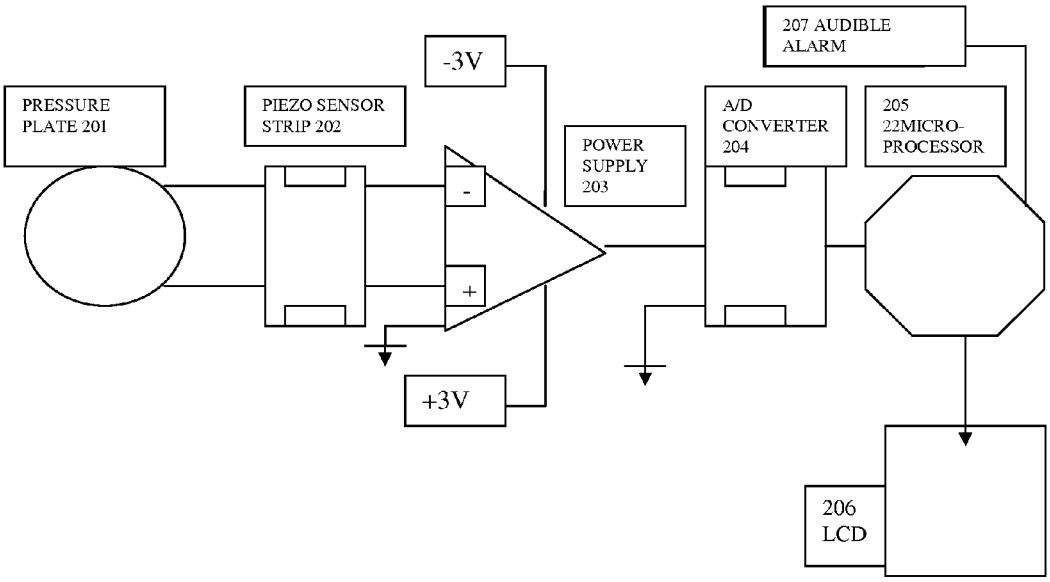
FIG. 2 is a block diagram of the monitoring circuit of the instant invention.
Figure 2:
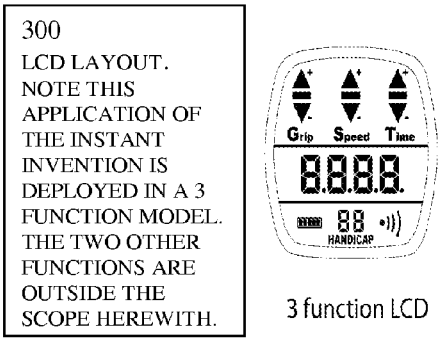

Inside the housing or watch casement are the various components arrayed in FIG. 2. Two very thin gauge electrical wires lead from a piezo sensor strip 202 and are soldered to the pressure plate 201. The piezo strip registers pressure differentials as the wearer's grip varies when swinging a golf club, cricket bat, squash racquet, or the like. The signal from the piezo sensor is driven by a 3 Volt battery 203 and thence to an A/D converter 204. The numeric values assigned to the corresponding pressure is somewhat arbitrary but they do reflect differing magnitudes, say in a range from one to ten with 10 being the maximum grip pressure recorded and 1 being the minimum amount of pressure a person could exert on the handle. The architecture of the software embedded in the microprocessor 205 transmits the grip pressure value to the LCD 206 signaling the user of the instant invention whether or not she or he has exerted the same grip pressure as on the swing they are trying to repeat. The signal is an audible alarm 207 or buzzer indicating a deviation from the pre-set grip pressure value from the best swing set in a previous trial.

FIG. 3 is relatively self explanatory except to note that the up and down icons on the LCD 300 render a non numeric representation of the direction of the deviation in grip pressure from the benchmark or SAVED swing that the user is attempting to replicate. Obviously the up arrow indicates tighter grip pressure and the down arrow, lower or looser grip pressure.

FIG. 4 graphically depicts an idealize golf swing. Empirical data indicates that the arc of the swing in the down stroke generates a curvilinear distribution of grip pressures over time. The pressure sensor deployed in the instant invention is capable of capturing up to five discrete data points in this distribution. We have tested the hypothesis that grip pressure as measured by the instant invention is highest at approximately the point of contact with the ball, at point R3 in FIG. 4.

Our experiments and hypothesis testing have been limited to hitting a golf ball, but intuitively we might assume this will also hold true for swinging a baseball bat, tennis racquet, or the various other modes of swinging referred to above. Any one or some combination of the data points in the distribution may be used for the purposes of the golf application. Since the objective is to repeat the grip pressure on the swing that gives the best result, it has proven most reliable to take the arithmetic mean of the distribution as the indicator of each swing's grip pressure.

Thus the mean value of grip pressure is SAVED in the memory of the device and subsequent mean values of repeated trials are compared to the SAVED value. Deviations are signaled as identified above, and the mean grip pressure values, replicating those saved confirm that a successful swing has been completed.

The grip pressure sensor device in the preferred embodiment described here is in the form analogous to a wrist watch. This multi-function swing monitor is cinched tightly on the inside of the wrist in the pulse point area of the wearer by a stretchable band fastened by say, hook and loop VELCRO® material. On the back of the watch casement or housing is a domed shaped thin, pliable metal alloy plate which is, as noted, held in contact with the pulse points of the wearer by the watch strap/band.

A highly sensitive pressure sensor strip (e.g., a Tekscan FlexiForce® A201 Sensor) detects very subtle changes in grip pressure as the person wearing the device swings a golf club, baseball bat or some other mode of hand held equipment. The flexing and relaxing of the muscles and tendons in the wearer's wrist is detected, converted in to a digital value and can be saved in the memory of the swing monitor.

Grip pressure values from subsequent swings can be compared with that value SAVED in memory. Should a deviation in grip pressure be detected, an audible signal is activated, alerting the user they have failed to replicate the grip pressure on the SAVED or benchmark swing. This biofeedback is a time honored method of training and conditioning muscle memory.

As described herein, a device can include converter means connected intermediate each pressure sensor and electronic monitoring circuit. As described herein, a converter means can include an analog to digital signal converter. As described herein, an electronic monitoring circuit can include microprocessor means. As described herein, display means can include a liquid crystal display device. As described herein, a device can include alarm means connected to an electronic monitoring circuit. As described herein, alarm means may selectively provide an audible alarm signal. As described herein, alarm means may selectively provides a visual alarm signal. As described herein, a device can include switch means for selectively controlling the operation of an electronic monitoring circuit. As described herein, switch means can include reset switches connected to an electronic monitoring circuit and to display means. As described herein, a device can include position marking means on the front of said WATCH to assist in the positioning of a golf club relative to said strap during said golf swing.

As described herein, a self contained golf or any swing training device can include a WATCH or swing monitoring system adapted to be worn inside the wrist of the user, or at the pulse pressure point of the wearer, piezo pressure sensor, means mounted in said WATCH, means to measure the grip pressure exerted on a golf club, bat, racquet etc., during said swing.

The invention claimed is:

1. A housing configured for mounting to a human wrist, the housing comprising:

a wrist side configured for mounting adjacent to a palm side of the human wrist;

a pliable domed plate mounted on the wrist side of the housing and extending outwardly from the housing;

a piezo sensor physically connected to the pliable domed plate, the piezo sensor configured to provide input signals responsive to changes in shape of the pliable domed plate caused by moving tendons at the human wrist contacting the pliable domed plate; and circuitry configured to provide output pressures exerted by a hand extending from the human wrist calculated from the input signals provided by the piezo sensor responsive to the changes in shape of the pliable domed plate, wherein the output pressures exerted by the hand are grip pressures applied to a sport implement.

2. The housing of claim 1 wherein the piezo sensor comprises a sensor strip.

3. The housing of claim 2 further comprising wires leading from the sensor strip to the pliable domed plate to physically connect the pliable domed plate to the sensor strip.

4. The housing of claim 1 wherein the grip pressures comprise grip pressures selected from a group consisting of golf club grip pressures, baseball bat grip pressures, squash racquet grip pressures, cricket bat grip pressures, and tennis racquet grip pressures.

5. The housing of claim 1 further comprising a strap configured to mount the housing to the human wrist.

6. The housing of claim 5 wherein the strap comprises a flexible strap.

7. The housing of claim 1 further comprising an accelerometer.

8. The housing of claim 1 wherein the circuitry comprises an analog-to-digital converter.

9. The housing of claim 8 wherein the circuitry comprises a microprocessor configured to receive signals from the analog-to-digital converter and configured to provide signals to a display.

10. The housing of claim 1 comprising a display side opposite the wrist side.

11. The housing of claim 1 wherein the pliable domed plate comprises a metal plate.

12. The housing of claim 1 further comprising a battery.

13. A method comprising:

receiving an input signal responsive to input pressure applied to a pliable domed plate by moving tendons at a palm side of a human wrist contacting the pliable domed plate wherein the contacting causes changing of shape of the pliable domed plate and a piezo sensor, physically connected to the pliable domed plate, to respond electronically so as to form the input signal;

processing the input signal; and based on the processing, displaying a value to a display indicative of output pressure exerted by a hand extending from the human wrist, wherein the output pressures exerted by the hand are grip pressures applied to a sport implement.

14. The method of claim 13 further comprising saving the value to memory.

15. The method of claim 13 further comprising comparing the value to a value saved in memory.

16. The method of claim 13 comprising monitoring the output pressure exerted by the hand extending from the human wrist by repeating the receiving, processing and displaying.

17. The method of claim 13 comprising wires physically connecting the pliable domed plate and the piezo sensor.

* * * * *